US009920503B2

(12) United States Patent
Marchand

(10) Patent No.: US 9,920,503 B2
(45) Date of Patent: Mar. 20, 2018

(54) MECHANICAL SYSTEM COMPRISING A CONNECTING DEVICE BETWEEN A WEARING PART AND THE SUPPORT THEREOF, AND BUCKET OF A HEAVY CONSTRUCTION MACHINE

(71) Applicant: Safe Metal, Lyons (FR)

(72) Inventor: Fabrice Marchand, Saint Galmier (FR)

(73) Assignee: SAFE METAL, Lyons (FR)

( * ) Notice: Subject to any disclaimer, the term of this patent is extended or adjusted under 35 U.S.C. 154(b) by 50 days.

(21) Appl. No.: 15/023,173

(22) PCT Filed: Sep. 18, 2014

(86) PCT No.: PCT/EP2014/069869

§ 371 (c)(1),
(2) Date: Jul. 20, 2016

(87) PCT Pub. No.: WO2015/040101

PCT Pub. Date: Mar. 26, 2015

(65) Prior Publication Data

US 2016/0319520 A1 Nov. 3, 2016

(30) Foreign Application Priority Data

Sep. 20, 2013 (FR) ..... 13 59079

(51) Int. Cl.
*E02F 9/28* (2006.01)

(52) U.S. Cl.
CPC ..... *E02F 9/2841* (2013.01); *E02F 9/28* (2013.01); *E02F 9/2816* (2013.01); *E02F 9/2825* (2013.01); *E02F 9/2883* (2013.01)

(58) Field of Classification Search
CPC ..... E02F 9/2841; E02F 9/2808; E02F 9/2825; E02F 9/2858; E02F 9/2833; E02F 9/2816; E02F 9/2883; E02F 9/28
(Continued)

(56) References Cited

U.S. PATENT DOCUMENTS 6,708,431 B2 * 3/2004 Robinson ..... E02F 9/2825 37/456
7,313,877 B2 * 1/2008 Clendenning ..... E02F 9/2833 37/456

(Continued)

FOREIGN PATENT DOCUMENTS

CN 201334684 Y 10/2009
EP 0902132 A2 3/1999

(Continued)

OTHER PUBLICATIONS

International Search Report dated Nov. 28, 2014 in International Application No. PCT/EP2014/069869.

(Continued)

*Primary Examiner* — Robert E Pezzuto
(74) *Attorney, Agent, or Firm* — Knobbe, Martens, Olson & Bear, LLP

(57) ABSTRACT

The present invention relates to a mechanical system (1), comprising a support (10), a wearing part (20) and a connecting device (30) between the wearing part (20) and the support thereof (10). The device (30) comprises an elastic sheath (40) provided with an internal cavity (47) and with an external wall (44) that is adjustable in a housing (14) of the support (10), and a pin (50) having an elongate body along a pin axis (X50). According to the invention, the device (30) also comprises a cam (60) provided with an external wall (63) that is adjustable in the internal cavity (47) of the sheath (40) and with an internal cavity (64) intended to receive the pin (50), and when the device (30) is positioned in the housing (14) of the support (10), the pin (50) and the cam (60) are able to rotate as one in the internal cavity (47) of the sheath (40), between an insertion configuration (A) of the pin (50) into the cam (60) and at least one locking configuration in which the pin (50) bears, radially with respect to the pin axis (X50), against the wearing part
(Continued)

(20), while the cam (60) bears against the sheath (40) and deforms the external wall (44) thereof counter to the housing (14) of the support (10), thereby forming a coupling connection between the wearing part (20) and the support (10).

18 Claims, 8 Drawing Sheets

(58) Field of Classification Search
USPC ..... 37/446, 452–460; 172/701.1–701.3; 403/220, 320
See application file for complete search history.

(56) References Cited

U.S. PATENT DOCUMENTS

| | | | | |
|---|---|---|---|---|
| 8,387,290 | B2 * | 3/2013 | Campomanes ..... | E02F 9/2825 37/456 |
| 2007/0261278 | A1 * | 11/2007 | Campomanes ..... | E02F 9/2841 37/452 |
| 2008/0209772 | A1 | 9/2008 | Cui | |
| 2012/0051836 | A1 | 3/2012 | Jakubisin | |

FOREIGN PATENT DOCUMENTS

| | | | |
|---|---|---|---|
| GB | 2134965 | A | 8/1984 |
| WO | WO 99-16982 | A1 | 4/1999 |
| WO | WO 2008-119102 | A1 | 10/2008 |
| WO | WO 2008-119103 | A1 | 10/2008 |
| WO | WO 2012-024731 | A1 | 3/2012 |
| WO | WO 2013-030334 | A1 | 3/2013 |
| WO | WO 2013-030335 | A1 | 3/2013 |
| WO | WO 2013-030336 | A1 | 3/2013 |

OTHER PUBLICATIONS

French Search Report dated May 12, 2014 in French Application No. FR 1359079.

* cited by examiner

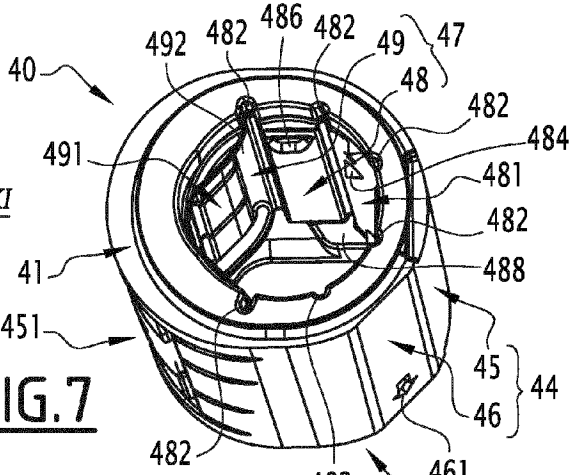
FIG.7
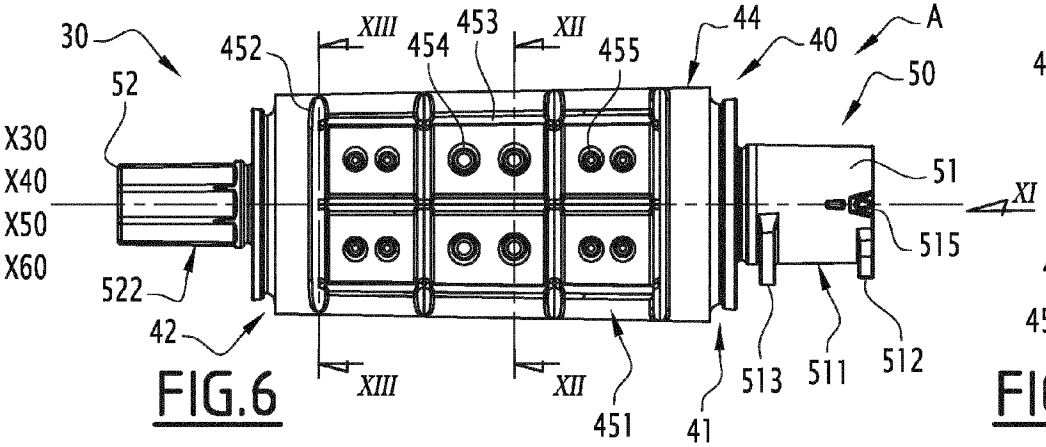
FIG.6
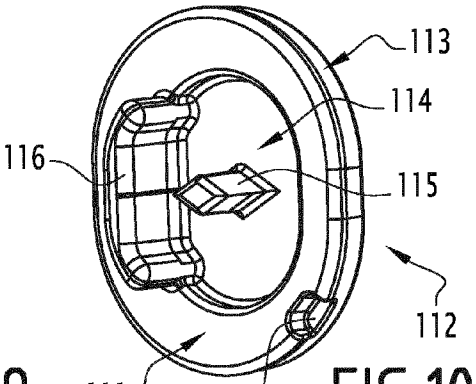
FIG.9
FIG.10
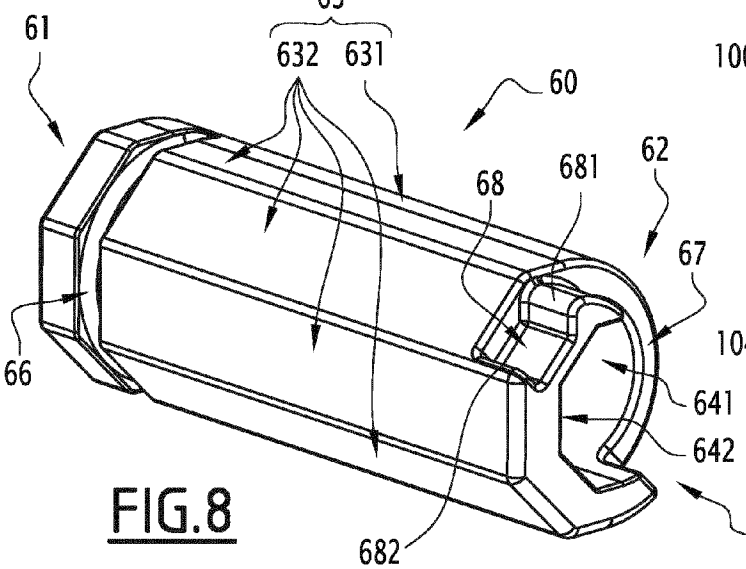
FIG.8

A
B
30
40
44
45
46
50
60
67
68
70
73
74
75
76
78
L50A
L50B
e50
e60
R0
R1
X14
X30
X40
X48
X50
X60
X64
451
452
481
482
484
491
492
511
512
514
515
531
532
533
551
615
631
632
641
642
643
681
682
412
415

A
40
1534
1644
X50
X64
1644
1534
X48
X60
1532
1642
X14
X30
X40

A
160
481
1632
X48
X60
150
40
170
1532
X50
X64
73
451
L150A

B1
160
150
40
170
X50
X64
451
L150B1

B2
160
150
X50
X64
40
170
451
L150B2

B3
X50
X64
150
160
40
170
451
L150B3

B4
150
X50
X64
160
40
170
X14
X30
X40
451
X48
X60
L150B4

MECHANICAL SYSTEM COMPRISING A CONNECTING DEVICE BETWEEN A WEARING PART AND THE SUPPORT THEREOF, AND BUCKET OF A HEAVY CONSTRUCTION MACHINE

CROSS REFERENCE TO RELATED APPLICATIONS

This application is the U.S. National Phase application under 35 U.S.C. § 371 of International Application No. PCT/EP2014/069869, filed Sep. 18, 2014, designating the U.S. and published as WO 2015/040101 A1 on Mar. 26, 2015, which claims the benefit of French Patent Application No. FR 1359079, filed Sep. 20, 2013. Any and all applications for which a foreign or a domestic priority is claimed is/are identified in the Application Data Sheet filed herewith and is/are hereby incorporated by reference in their entirety under 37 C.F.R. § 1.57.

BACKGROUND

The field of application of the invention is that of pieces of equipment of public works machines, in particular buckets, skips or other receptacles which may scrape, pick up and displace materials with view to their discharge from a given location to other operating stations by means of public works machines.

The present invention relates to a mechanical system comprising a support, a wearing part and a device for connection between the wearing part and its support, notably a tooth and its support belonging to a public works machine piece of equipment. The invention also relates to a public works machine bucket comprising at least such a system.

In a known way, a bucket includes a leading blade equipped with wearing parts provided for their capability of penetration of the material and of protection of the other constitutive elements of the bucket. On leading blades are attached adapter-supports having a profiled nose, while the wearing parts are teeth or shields which will be positioned on the adapter-support according to a specific connection. This connection is temporary in order to allow replacement of the wearing parts after wear.

The connection between the wearing part and its support may be achieved by keying. In order to be performing, the keying devices should ensure a rigid connection of the elements which they join up. Conventionally, assembling and disassembling of the keyings is carried out by the action of percussion tools, with the risk of injuries for the operators.

Keying devices are also known which do not require the use of percussion tools. In the past, such devices required pieces of constraining special equipment, notably for disassembling the wearing part. Further, such devices were complex to manufacture and to use.

WO-A-2013/030335 describes a mechanical system comprising an improved keying device, not requiring the use of percussion tools. The device comprises an elastically deformable sheath and a rigid key, mobile and secured to each other in rotation.

US-A-2008/209772 describes a mechanical system, comprising a support 106, a wearing part 102 and a connecting device between the wearing part 102 and its support 106. The connecting device comprises a body 100, a sheath 200, a key 300 and a rod 350. The body 100 is provided with an internal cavity and an adjustable external wall in a housing of the support 106. The sheath 200 is in an elastically deformable material, provided with an internal cavity 202 and with an adjustable external wall 204+206 in a housing of the body 100, and not in a housing of the support 106. The key 300 includes an elongated body 304 along a key axis and a head provided with a latch 340. The rod 350 may be inserted into a housing of the body 100 for blocking the key 300 in position in the body 100.

SUMMARY

The object of the present invention is to propose a novel connecting device, giving the possibility of doing without the percussion operations for the assembly like for the disassembly of the wearing parts, while being performing, reliable, resistant and practical.

For this purpose, the object of the invention is a mechanical system, comprising a support, a wearing part and a connecting device between the wearing part and its support, notably a bucket tooth and its support which belong to a piece of equipment of a public works machine, the connecting device comprising a sheath in an elastically deformable material, provided with an internal cavity and an external wall adjustable in a housing of the support, and a key including an elongated body along a key axis. The mechanical system is characterized in that the connecting device also comprises a cam provided with an external wall adjustable in the internal cavity of the sheath and with an internal cavity provided for receiving the key, and in that when the connecting device is positioned in the housing of the support, the key and the cam are mobile and secured to each other in rotation in the internal cavity of the sheath, between: a configuration for inserting the key into the cam, and at least one locking configuration wherein the key, radially to the key axis, bears against the wearing part, while the cam bears against the sheath and deforms its external wall against the housing of the support, thereby forming a coupling connection between the wearing part and the support.

Thus, the invention ensures satisfactory maintaining of the wearing part on its support and permanent balancing of the forces generated within the operating mechanical system. In particular, the invention ensures balancing of the forces generated within the connecting device and of the forces generated by the connecting device on the support and the wearing part, notably along a direction parallel to the axis of the key. This limits the stress concentrations on sensitive elements like the key or the lugs of the wearing part, which may cause premature wear, deformations as well as breakages of these elements.

Upon passing from the insertion configuration to the locking configuration, the connecting device ensures initial tensioning of the compressed sheath against the support and the key bearing against the wearing part. The invention thus gives the possibility of catching up with the plays due to wear, mainly generated by the matting of the wearing part on the support because of the thrust forces specific to the operation of such a mechanical system. In the case when the connecting device defines a unique locking configuration, the operator may carry out initial tensioning of the system in significant but appropriate proportions. In the case when the connecting device defines several successive locking configurations, the operator may cause modification of the tensioning gradually during the wear, by simply pivoting the key and without disassembling the system.

The mechanical system according to the invention also integrates a significant sealing function for the targeted applications. This seal is ensured within the connecting device and at its interface with the support and the wearing part, so as to compensate for the mobilities within the mechanical system, during mounting, during locking and upon operating. This sealing function takes into account the different movements and deformations of the constitutive elements of the mechanical system, notably of the sheath, of the key and of the cam ensuring contact and positioning under permanent tension of the wearing part on the support.

According to other advantageous features of the invention, taken individually or as a combination:

- The key and the cam are mobile and secured to each other in rotation in the internal cavity of the sheath between the insertion configuration and the single locking configuration by pivoting by a given angle, for example an angle equal to 180 degrees.
- The connecting device includes means for notching the cam in the locking configuration.
- The notching means are formed by a recess made on the cam and a boss formed in another constitutive element of the connecting device.
- The key and the cam are mobile and secured to each other in rotation in the internal cavity of the sheath between several locking configurations, by pivoting by a given angle between each locking configuration, for example an angle equal to 45 degrees.
- The connecting device includes means for notching the cam in each of the locking configurations.
- The notching means are formed by internal planar surfaces belonging to the sheath and external planar surfaces belonging to the cam.
- The connecting device also comprises an intermediate part positioned against the cam in the internal cavity of the sheath, this intermediate part including an internal face bearing against the external wall of the cam and an external face bearing against the internal wall of the sheath.
- The connecting device also comprises at least one adapted ring-shaped joint so as to be positioned at a longitudinal end of the sheath, preferably two adapted ring-shaped joints so as to be each available at one longitudinal end of the sheath, and in the insertion configuration and in the locking configuration(s), said or each ring-shaped joint bears both against the support, the wearing part, the sheath and the key.
- The mechanical system also comprises at least one plug adapted so as to be positioned in an orifice of the wearing part which will face the housing of the support when the wearing part is mounted on the support, preferably two adapted plugs so as to be each available in an orifice of the wearing part, said or each plug preventing the intrusion of outer materials around the key and into the housing of the support.
- The key includes a head and a foot adapted so as to be each housed in a cavity of the wearing part, and in said or each locking configuration, the head and the foot radially to the key axis, bearing against one of the cavities of the wearing part along a first direction while the body radially to the key axis bears against the cam along a second direction opposite to the first direction.
- The key includes means for dual axial retention along the key axis in said or each locking configuration.
- The key and the cam comprise means for securing them in rotation.
- The securing means in rotation are formed by ribs and complementary grooves made on the key and the cam.

The object of the invention is also a public works bucket comprising at least one mechanical system as mentioned above. In practice, the bucket generally comprises a series of supports each receiving one tooth which behaves as a wearing part and is secured to its support through a connecting device.

Alternatively, other public works machine pieces of equipment may also be equipped with the mechanical system according to the invention.

BRIEF DESCRIPTION OF THE DRAWINGS

The invention will be better understood upon reading the description which follows, only given as a non-limiting example and made with reference to the appended drawings wherein:

FIG. 6 is a view of the connecting device along the arrow VI in FIG. 1, showing in an insertion configuration the support and the wearing part;

FIG. 7 is a perspective view of the sheath shown alone;

FIG. 8 is a perspective view of the notched cam mounted alone;

FIGS. 9 and 10 are perspective views of two suitable plugs for being inserted into the wearing part when the connecting device is in a configuration for locking the wearing part with respect to the support;

DETAILED DESCRIPTION

Figure 1:
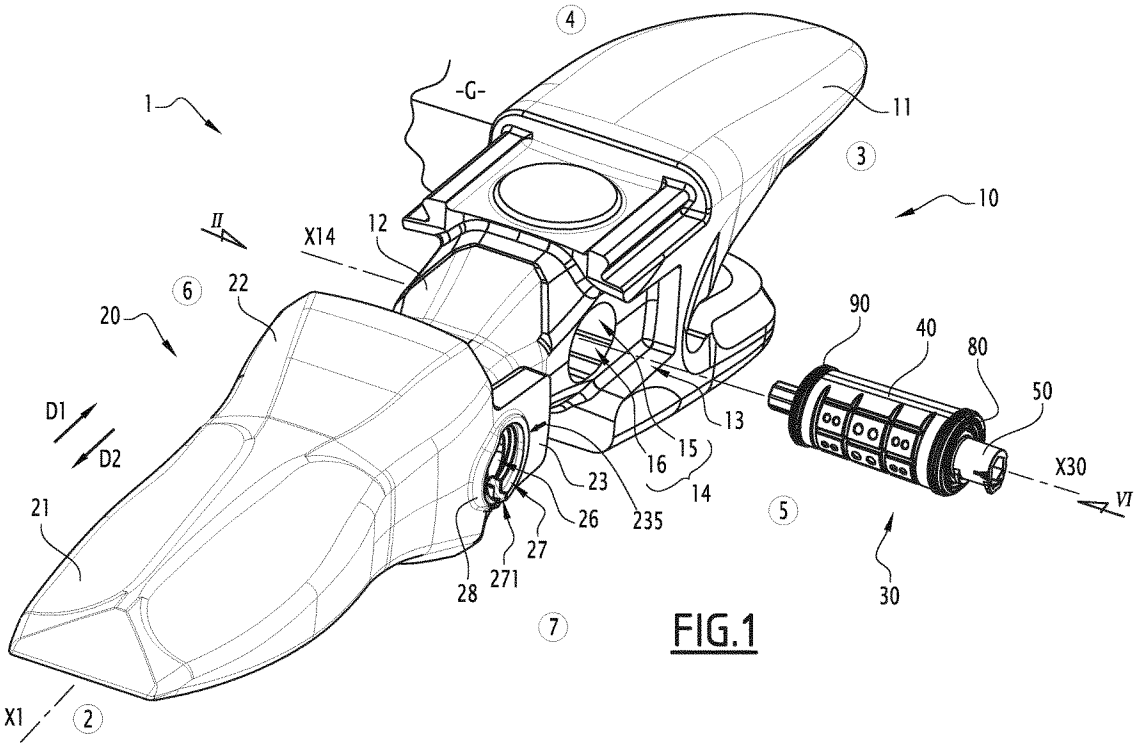
FIG. 1 is an exploded perspective view of a mechanical system according to the invention, comprising a partly illustrated support secured to a bucket, a wearing part, as well as a device for connecting the wearing part and the support.
Figure 3:
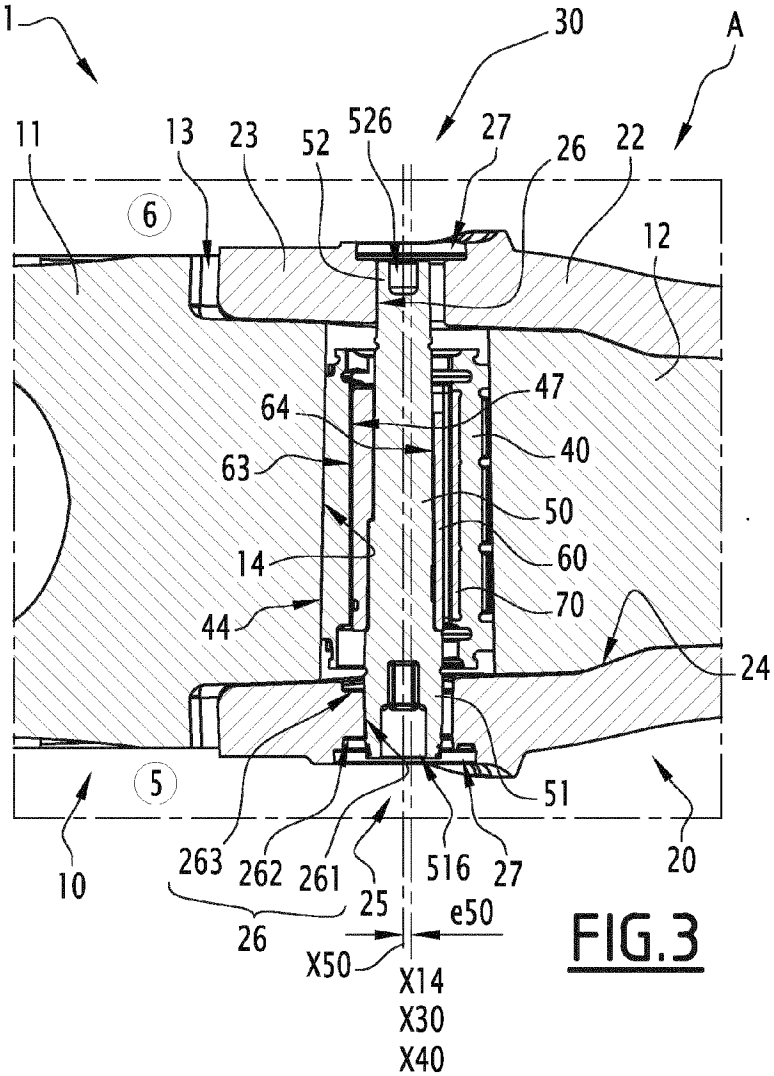
FIG. 3 is a partial sectional view along the line III-Ill in FIG. 2.
Figure 2:
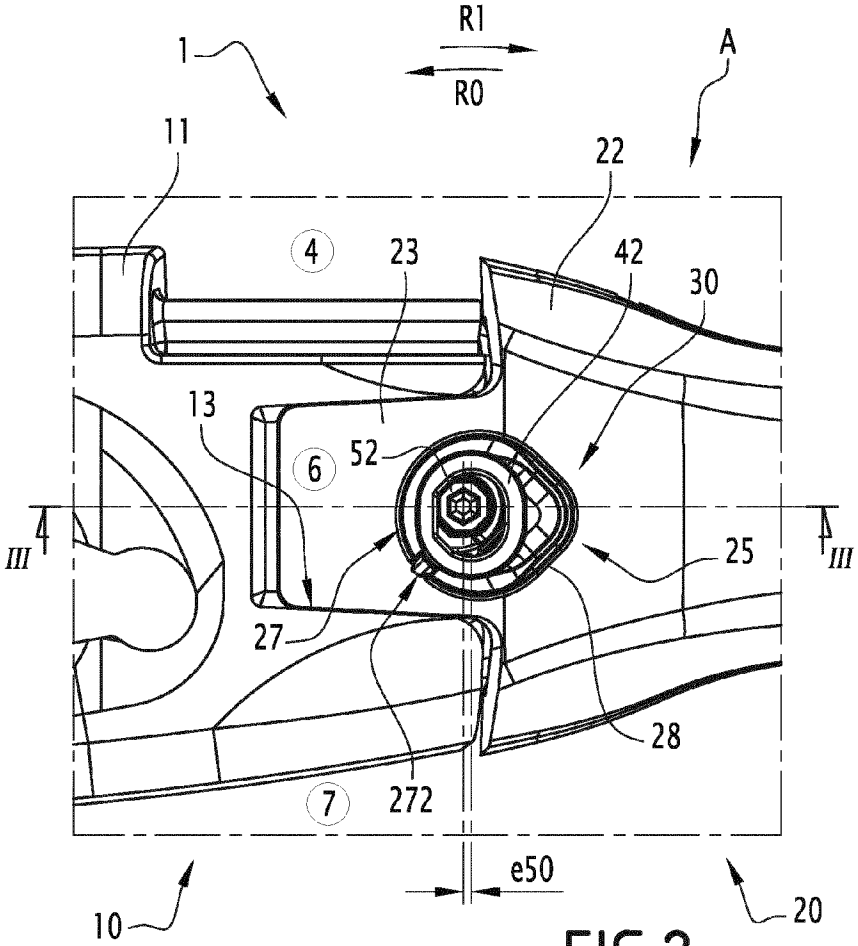
FIG. 2 is a partial side view along the arrow II in FIG. 1.
Figure 4:
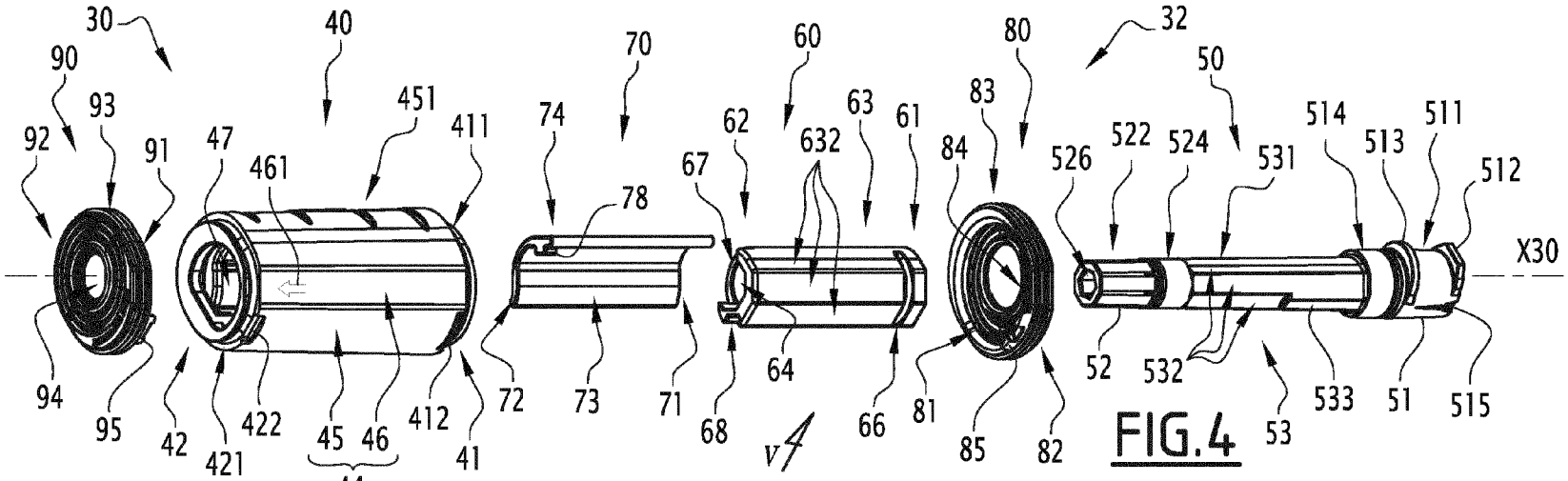
FIG. 4 is an exploded perspective view of the connecting device, comprising a sheath, a key, a notched cam, a crescent and two joints.
Figure 5:
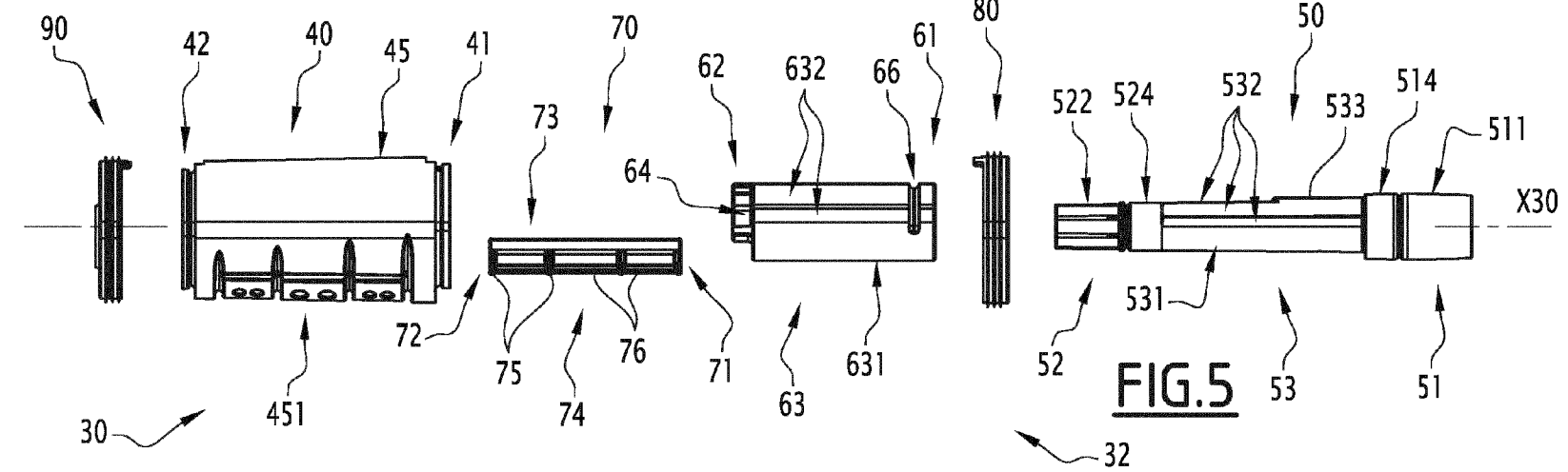
FIG. 5 is a side view along the arrow V in FIG. 4.

In FIGS. 1 to 3, a mechanical system 1 is illustrated according to the invention, fitting out a bucket G of a public works machine.

The mechanical system 1 comprises an adapter-support 10, a wearing part 20 of the tooth or tip type, as well as a connecting device 30 between the support 10 and the tooth 20. The system 1 substantially extends along an axis X1, along which a first direction D1 for press-fitting the tooth 20 on the support 10 and a second direction D2, parallel and opposite to the first direction D1, for disassembling the tooth 20, are defined.

The bucket G is partly illustrated in FIG. 1, with the purpose of simplification. The support 10 is secured to the bucket G, while the tooth 20 is a wearing part intended to be disassembled when it is too worn by the operation of the bucket G.

The connecting device 30 globally extends along a central axis X30 and comprises a sheath 40, a key 50, a notched pusher cam 60, a crescent 70, as well as two joints 80 and 90. The parts 40, 50, 60, 70, 80 and 90 are distinct. Preferably each of the parts 40, 50, 60, 70, 80 and 90 is in one piece.

The connecting device 30 is adjustable in a housing 14 of the support 10, with the sheath 40 which is in contact with the walls of this housing 14. The key 50 and the cam 60 are then mobile and secured to each other in rotation in the sheath 40. The key 50 and the cam 60 pivot between a configuration A for inserting the device 30 into the housing 14 on the one hand, wherein the key 50 is inserted into the notched cam 60 and a configuration B for locking the device 30 on the other hand wherein the key 50 radially to the axis X30 bears against the tooth 20, while the notched cam 60 bears against the sheath 40 and deforms it in the housing 14 of the support 10, then forming a coupling connection between the tooth 20 and its support 10. The sheath 40 is static, i.e. not rotationally mobile with the key 50 and the cam 60.

Figures 11, 12, 13, 14, 15, 16:
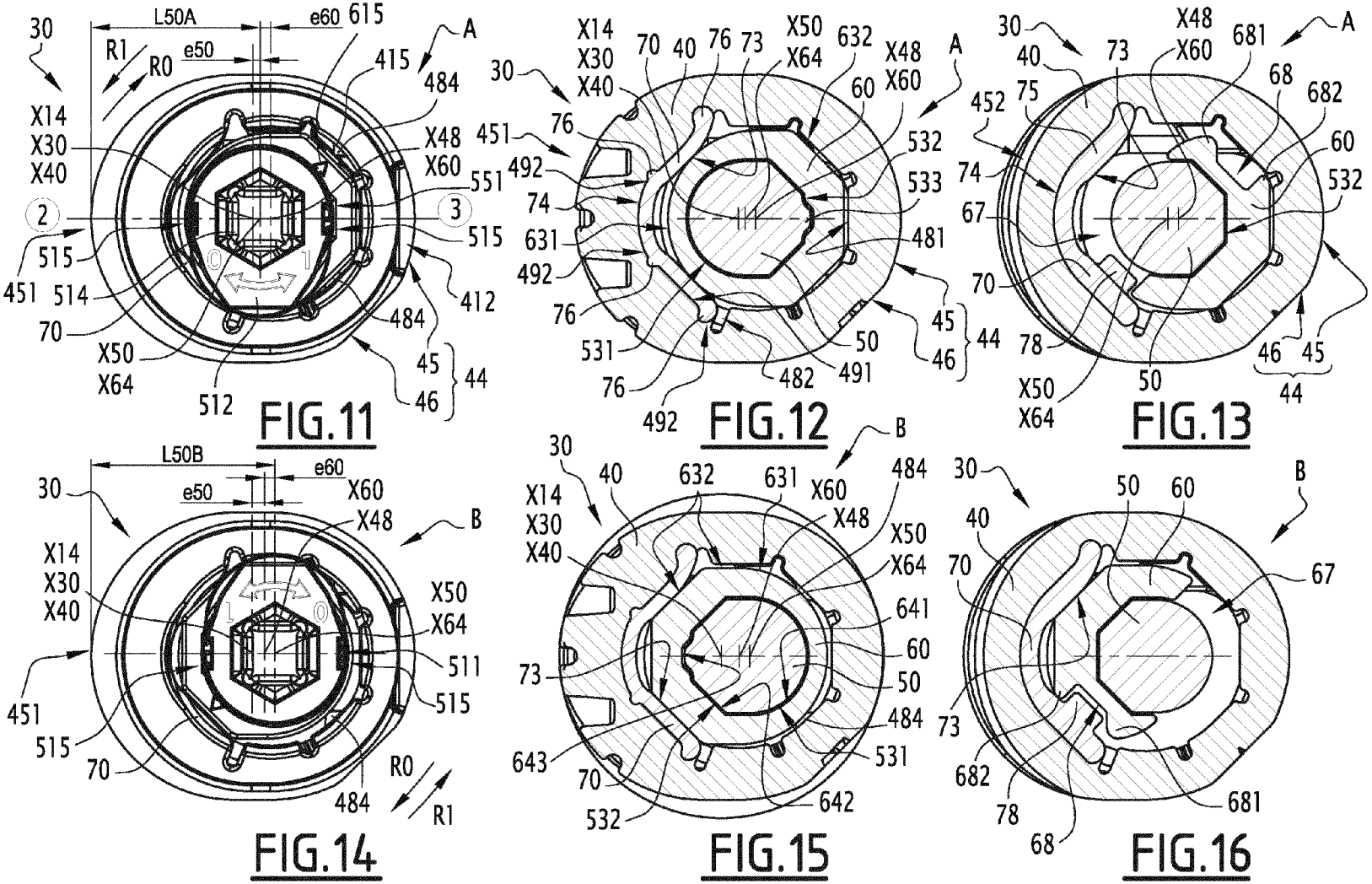
FIG. 11 is a side view along the arrow XI in FIG. 6, showing the connecting device in the insertion configuration.
FIGS. 12 and 13 are sectional views, respectively along the line XII-XII and along the line XIII-XIII in FIG. 6.
FIG. 14 is a view similar to FIG. 11, showing the connecting device in the locking configuration.
FIGS. 15 and 16 are similar sectional views to FIGS. 12 and 13, respectively, showing the device in a locking configuration like in FIG. 14.
Figure 17:
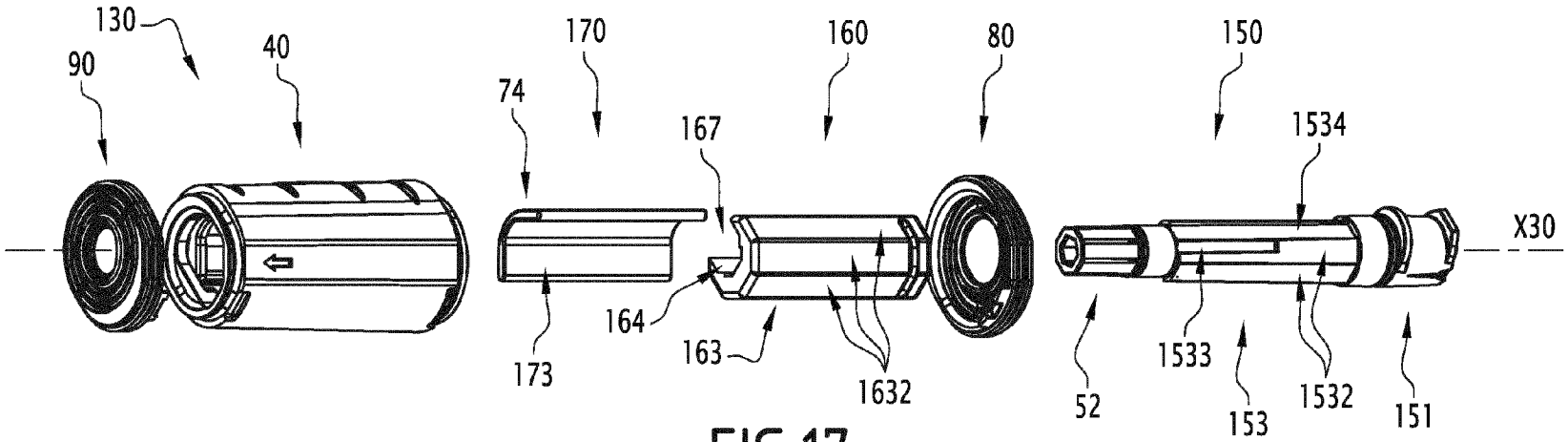
FIGS. 17 to 19 are similar views to FIGS. 4 to 6, respectively showing a connecting device according to a second embodiment of the invention.
Figure 18:
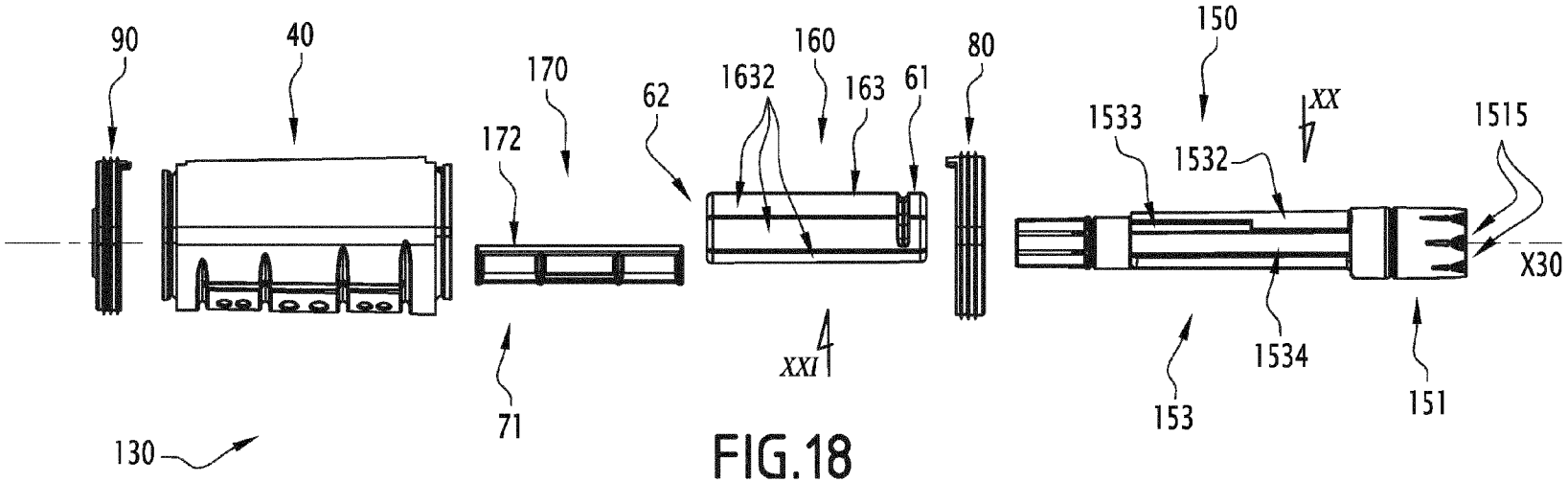
Figure 22:
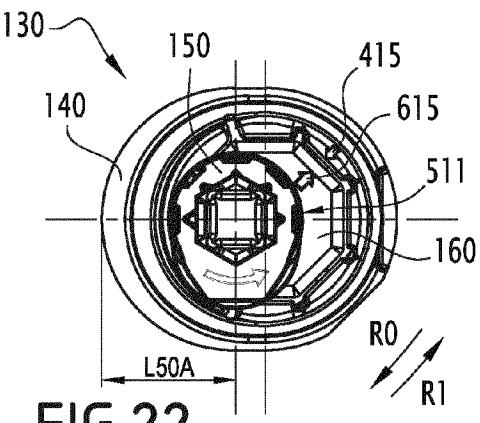
FIG. 22 is a side view along the arrow XXII in FIG. 19, showing the connecting device in an insertion configuration.

During the locking of the device 30, in order to pass from the configuration A to the configuration B, the key 50 and the cam 60 perform a 180° rotation R1. During the unlocking of the device 30, in order to pass from the configuration B to the configuration A, the key 50 and the cam 60 perform a 180° rotation R0 in the opposite direction to the rotary direction R1. The insertion configuration A is shown in FIGS. 2, 3, 6 and 11 to 13, while the locking configuration B is shown in FIGS. 14 to 16. FIG. 1 shows an assembling configuration resulting in the insertion configuration A.

In order to facilitate the localization of the different portions of the mechanical system 1 in space, a front side 2 is defined at which is located the tooth 20, a rear side 3 at which is located the support 10, an upper side 4 oriented opposite to the ground when the system 1 is assembled, a first side 5 for inserting the device 30 into the support 10, a second side 6 opposite to the insertion side 5, as well as a lower side 7 oriented towards the ground when the system 1 is assembled. The sides 5 and 6 respectively correspond to the left and to the right of the system 1 relatively to the disassembling direction D2.

The support 10 comprises a base 11 provided so as to be attached to the bucket G, as well as a fitting nose 12 provided so as to be engaged into a cavity 24 of the tooth 20 conformed for this purpose, as shown in FIG. 3. Further, a housing 13 for receiving the lugs 23 of the tooth 20 is made on each side 5 and 6 of the base 11. Each housing 13 includes walls located towards the rear 3, the top 4 and the bottom 7, and is open towards the front 2 in order to receive the lugs 23.

The housing 14 extends through the nose 12, along an axis X14, while opening on the sides 5 and 6. This housing 14 is partly surrounded by the housings 13 on the sides 5 and 6. The housing 14 includes a rounded inner surface 15 and a planar inner surface 16, which globally extends along the axis X14. The planar surface 16 is located towards the rear 3 and the bottom 7 of the housing 14, while being oriented towards the front 2 and the top 4 of this housing 14. In a sectional plane perpendicular to the axis X14, the housing 14 has a cross-section which decreases from the side 5 towards the side 6. This cross-section has a globally oval shape defined by the surface 15, with a rectilinear portion defined by the surface 16. The surfaces 15 and 16 converge towards the side 6. The housing 14 is provided for receiving the sheath 40, with the planar surface 16 which is provided for receiving a planar surface 46 belonging to the sheath 40.

The tooth 20 comprises an active portion 21 located towards the front 2 and a hollow portion 22 oriented towards the rear 3. In a known way per se, the portion 21 is provided for scraping and picking up materials, for example earth or gravel, while the portion 22 is provided for fitting the tooth 20 onto the support 10. More specifically, the portion 22 comprises the inner cavity 24, conformed for the fitting of the support 10 on the nose 12, as well as the lugs 23 which are oriented towards the rear 3 and provided for being received into the housings 13, in contact with the top 4 and the bottom 7, as shown in FIG. 2. The lug 23 located on the side 5 includes a marking 215, in this case a molded or engraved arrow on the external face of the lug 23 on the example of FIG. 1. The marking 235 facilitates the insertion of the device 30 into the housing 14 in the insertion configuration A, with a specific initial position. The marking 235 also facilitates localization of the configuration B.

As shown in FIGS. 1 to 3, side orifices 25 are made on either side of the tooth 20 on the sides 5 and 6. The orifices 25 are positioned facing the housing 14 when the tooth 20 is fitted onto the support 10, then allowing insertion of the key 50 and the application of the device 30 positioned in the support 10 and the tooth 20. Each orifice 25 has a globally cylindrical shape, with widening on the front side 2. Each orifice 25 is partly made in one of the lugs 24. Each orifice 25 includes a cavity 26 for receiving the pin 50 opening outside the housing 14, as well as a cavity 27 for receiving a plug 100 or 110. The cavity 27 located on the side 5 includes a groove 271, while the cavity 27 located on the side 6 includes a boss 272. Each orifice 25 includes a border 28 formed as a protrusion on the side 5 or 6 of the tooth 20.

In practice, the cavities 26 are provided for receiving the key 50 bearing upon the tooth 20 in the locking configuration B, as detailed hereafter. More specifically, the cavity 26 located on the insertion site 5 is provided for receiving the head 51, while the cavity 26 located on the side 6 is provided for receiving the foot 52. The cavity 26 located on the side 5 includes three portions 261, 262 and 263 for receiving different portions of the head 51, as detailed hereafter. The portion 261 is located between the portions 262 and 263 and has a lower dimension radially to its central axis. The portion 262 is located on the outer side of the orifice 25, on the side 5 of the tooth 2. The portion 263 is located on the inner side of the orifice 25, facing the housing 14.

When the system 1 is assembled, with the tooth 20 fitted onto the support 10, and the device 30 is in an insertion configuration A, the axes X1, X14 and X30 are substantially located in a same median plane Pm1 of the system 1, as shown in FIG. 2.

The sheath 40 is in an elastically deformable material, for example in elastomer. The sheath 40 is provided for ensuring the tensioning of the different constitutive elements of the system 1. The sheath 40 is elongated between longitudinal ends 41 and 42 following a central axis X40, which is provided so as to be aligned with the axis X14 of the housing 14 and is globally aligned with the axis X30 of the device 30. In the insertion configuration A, the end 41 is located on the side 5, while the end 42 is located on the side 6. The end 41 includes a marking 415, in this case an arrow in particular shown in FIG. 11, provided for facilitating the relative orientation between the sheath 40 and the cam 60. The sheath 40 includes a ring-shaped groove 411 including a radial recess 412 at the end 41 and a ring-shaped groove 421 including a radial recess 422 at the end 42. Thus, the ends 41 and 42 are adapted for receiving the joints 80 and 90.

The sheath 40 comprises an external wall 44, including a rounded surface 45 and a planar surface 46, which globally extends along the axis X40. In the insertion configuration A, the planar surface 46 is located towards the rear 3 and the bottom 7 of the wall 44. In a sectional plane perpendicular to the axis X40, the wall 44 has a cross-section with a globally oval shape defined by the surface 45, with a rectilinear portion defined by the surface 46. This cross-section globally decreases from the end 41 to the end 42. In other words, the wall 44 converges upon getting closer to the end 42, as shown in FIG. 6.

In practice, the housing 14 and the external wall 44 have substantially mating shapes, so that the sheath 40 may be adjusted in the housing 14 of the support 10. The planar surface 46 will then bear against the planar surface 16. In other words, the surfaces 16 and 46 form fail-safe means facilitating the positioning of the sheath 40 in the housing 14. The planar surface 46 preferably includes a marking, in this case an arrow on the example of FIG. 7, facilitating the insertion of the sheath 40 into the housing 14, with a specific initial position, in the insertion configuration A.

The rounded surface 45 includes a localized compression absorption and deformation area 451, located on the front side 2 when the sheath 40 is positioned in the housing 14. The area 451 includes circumferential grooves 452, longitudinal grooves 453, central blind holes 454 of large size and side blind holes 455 of a small size. On the example of the figures, as in particular shown in FIG. 6, the area 451 includes four grooves 452 and three grooves 453, four central holes 454 and eight side holes 455. Alternatively, the area 451 may include various localized recesses distributed according to any layout and with any shapes adapted to the present application, producing a targeted weakening of the wall 44. The area 451 is made for facilitating the deformations of the sheath 40 in compression, during its passing through the orifice 25 on the one hand, in the housing 14 under the action of the cam 60 on the other hand. The deformations of the sheath 40 are not shown in the figures with a purpose of simplification.

As shown in FIGS. 7 and 11 to 16, the sheath 40 also comprises a longitudinal internal cavity 47 off-centered relatively to the axis X40. The sheath 40 is globally ring-shaped and the cavity is closed, except for the ends 41 and 42. The cavity 47 comprises a portion 48 for receiving and supporting the cam 60, as well as a portion 49 for receiving and supporting the crescent 70. The portion 49 is positioned opposed to the area 451 of the sheath 40. The portion 48 comprises substantially planar supporting surfaces 481 surrounded by longitudinal grooves 482, while the portion 49 comprises substantially convex supporting surfaces 491 surrounded by longitudinal grooves 492, the functions of which will be detailed hereafter. The surfaces 481 and 482 and the grooves 491 and 492 are distributed on the perimeter of the cavity 47 and extend along the longitudinal direction of the sheath 40 between the ends 41 and 42. The portion 48 and in particular its surfaces 481 define a longitudinal axis X48 parallel to the axis X40, with a constant off-center distance made between them in a plane perpendicular to the axis X40.

In the example of FIGS. 7 and 11 to 16, the cavity 47 comprises five surfaces 481, six grooves 482, three surfaces 491 and four grooves 492. Alternatively, the cavity 47 may include different surfaces and grooves according to any layout and to any shapes adapted to the present application.

In the cavity 47 of the sheath 40, the portion 48 also includes conical pins 484, formed on two of the surfaces 481 and elastically deformable in contact with the cam 60. These pins 484 give the possibility of catching up the plays between the sheath 40 and the cam 60, and ensure proper positioning of the cam 60 against the crescent 70. The portion 48 also includes a tab 486, shown in FIG. 7, formed on the side of the end 41 on one of the surfaces 481. The tab 486 is provided for cooperating with a groove 66 made in the cam 60. The portion 48 also includes an abutment 488, shown in FIG. 7, formed on the side of the end 42. The tab 486 and the abutment 488 ensure proper positioning of the cam 60 in the sheath 40 along the axis X30 and its blocking during pre-assembling of the device 30.

The key 50 is metal, for example in steel. The key 50 comprises a head 51, a foot 52, as well as an elongated body 53 along an axis X50 between the head 51 and the foot 52. The key 50 is mobile in rotation R1 or R0 between two distinct positions, respectively corresponding to the insertion configuration A and the locking configuration B. The head 51 and the foot 52 are provided for cooperating with the tooth 20 at the orifices 25, while the body 53 is provided for cooperating with the cam 60.

A variable off-center distance e50 is defined between the axes X40 and X50 in a plane perpendicular to these axes X40 and X50. The off-center distance e50 is larger in the locking configuration B than in the insertion configuration A, as notably shown in FIGS. 11 and 14.

The head 51 includes an external surface 511 having a cylindrical cross-section. The head 51 also includes means for dual axial retention along the axis X50, i.e. lugs 512 and 513 formed as protrusions on the surface 511. The lug 512 includes three substantially planar external faces, while the lug 513 includes a rounded external surface. The head 51 is provided for being supported in the orifice 25 of the tooth 20 located on the side 5, by the surface 511 which will be supported in the portion 261 of the orifice 25, while the lugs 512 and 513 will be housed in the portions 262 and 263 of the orifice 25. The lugs 512 and 513 give the possibility of preventing accidental withdrawal of the key 50 found in an intermediate catch position between the insertion configuration A and the locking configuration B.

The head 51 also comprises a second external surface 514 having a cylindrical cross-section. The surface 514 is located on the other side of the lug 513 with respect to the surface 511, while being closer to the body 53. The head 51 also comprises markings 515, corresponding to the configurations A and B, provided for facilitating handling and orientation of the key 50. Each of the markings 515 of the key 50 is positioned facing the marking 235 of the tooth 20 in one of the configurations A or B. The foot 52 comprises an external portion 522 having a hexagonal section and an external surface 524 having a cylindrical section. The portion 522 gives the possibility of obtaining a compromise between the rotational mobility of the key 50 and the extent of the supporting surface of the foot 52 on the tooth 20, in correspondence with the scalable notching of the cam 60. The portion 522 limits the rotation of the key 50 once it is in the locking configuration B. The surface 524 is closer to the body 53 than to the portion 522. The surfaces 514 and 524 are provided for receiving the joints, 80 and 90 respectively.

The head 51 also comprises a hexagonal cavity 516 for actuation by a tool, not shown for the sake of simplification. Preferably, the foot 52 also has a hexagonal cavity 526 for it to be driven by a second tool. Alternatively, the head 51 and the foot 52 may be conformed differently, for actuation by other types of tools.

The body 53 extends between the surfaces 514 and 524. The body 53 comprises a rounded surface 531 and five neighboring planar surfaces 532, distributed around the axis X50. Both surfaces 532 bordering the surface 531 have dimensions smaller than the other surfaces 532. A rib 533 is formed on a portion of the planar surface 532 of the middle, on the side of the surface 514 of the head 51. The surfaces 532 and the rib 533 extend along the longitudinal direction defined parallel to the X50 axis. The surfaces 532 and the rib 533 form positioning and indexing means defined in correspondence with the cam 60.

The notched cam 60 is metal, for example in steel. The cam 60 gives the possibility, by its rotation R1 and its change in position, of compressing the whole of the constitutive elements of the device 30. The cam 60 may also be described as an off-centered pusher. The cam 60 extends between a front end 61 and a rear end 62 along an axis X60. Along this axis X60, the cam 60 has a length equal to at least 30% of the length of the key 50, in this case about 48% on the example of FIGS. 1 to 5. The end 61 includes a marking 615, in this case an arrow in particular shown in FIG. 11, provided so as to be positioned facing the marking 415 of the sheath 40 in the insertion configuration A. The markings 415 and 615 give the possibility of facilitating the relative positioning of the sheath 40 and of the cam 60 in the configuration A. The cam 60 comprises an external wall 63 including a rounded surface 631 and planar surfaces 632, connected through slightly rounded obtuse angles. In the example of FIGS. 4, 5, 8 and 11 to 16, the wall 63 comprises five surfaces 632. The cam 60 is provided so as to be received into the internal cavity 47 of the sheath 40, more specifically in its portion 48, in contact with the crescent 70. More specifically, the wall 63 is positioned, being supported against the surfaces 481 of the sheath 40 and against the internal face 73 of the crescent 70.

In the insertion configuration A shown in FIGS. 11 to 13, the rounded surface 631 is supported against the internal face 73, while the planar surfaces 632 bear against the surfaces 481. In the locking configuration B, shown in FIGS. 14 to 16, after the 180° rotation R1, the planar surfaces 632 bear against the internal face 73, while the rounded surface 631 bears against the surfaces 481. The surfaces 632 form notches during the rotation R1 or R0 of the notched cam 60 in the cavity 47 of the sheath 40.

The cam 60 also comprises an internal cavity 64 defining a central axis X64 parallel to the axis X60, with an off-center distance e60 made between them in a plane perpendicular to the axis X60. The off-center distance e60 is constant in the configurations A and B, as notably shown in FIGS. 11 and 14. Upon passing from the configuration A to the configuration B, the axis X60 is shifted towards the front 2, so that the cam 60 presses against the crescent 70 and the sheath 40 in the area 451.

The cavity 64 includes a rounded surface 641, three neighboring planar surfaces 642 and a groove 643 made in the planar surface 642 of the middle. The surfaces 642 and the groove 643 extend along the longitudinal direction defined parallel to the axis X60. The cavity 64 is provided for receiving the body 53 of the key 50. The cooperation between the surfaces 532 and 642, the rib 533 and the groove 643 gives the possibility of defining the proper positioning of the key 50 in the cam 60. In other words, these elements 532, 642, 533 and 643 form fail-proof means facilitating the positioning of the key 50 in the cam 60. Further, these elements 532, 642, 533 and 643 are means for securing in rotation R1 or R0 the key 50 with the cam 60.

On the side of the end 61, the cam 60 includes a groove 66 made around the axis X60 on a portion of the wall 63. The groove 66 is provided for cooperating with the tab 486 shown in FIG. 7, located in the internal cavity 47 of the sheath 40 on the sides of the end 41. By cooperating with the tab 486, the groove 66 gives the possibility of translationally positioning the cam 60 in the sheath 40 and of blocking it in the right position upon pre-assembling the device 30.

On the side of the end 62, the cam 60 includes an aperture 67 and a recess 68. The aperture 67 is made between the wall 63 and the cavity 64. At this aperture 67, one of the surfaces 632 is curved towards the axis X60. The recess 68 made in the cam 60 is provided for receiving a boss 78 belonging to the crescent 70 at the end of the rotation R1. The recess 68 is made in the wall 63, while opening at one of the surfaces 632 and of the end 62. The recess 68 is surrounded by two abutments 681 and 682. The recess 68 and the boss 78 give the possibility of physically materializing both configurations A and B of the device 30. The aperture 67 allows the passing of the catch 78 during the rotation of the cam 60 driven by the key 50.

The crescent 70 is in metal, for example in steel. The crescent 70 extends between a front end 71 and a rear end 72 along the axis X30. The crescent 70 includes a concave internal face 73 and a convex external face 74. The external face 74 includes a series of longitudinal ribs 75 parallel to the axis X30. The external face 74 also includes a series of transverse ribs 76 which are distributed from the end 71 as far as the end 72, which connect the longitudinal rib 75 and which have a curved shape.

The crescent 70 is an intermediate part between the sheath 40 and the cam 60. The crescent 70 is attached in the portion 49 of the cavity 47 of the sheath 40 by overmolding, more specifically by injection of the material of the sheath 40 on the crescent 70. For this purpose, the crescent 70 is placed in a mold before injecting the constitutive material of the sheath 40. The crescent 70 gives the possibility of maximizing the volume of the compressed sheath 40 between the support 10 and the cam 60, while protecting this sheath 40 from the wear caused by the rotation R1 of the cam 60. The crescent 70 gives the possibility of absorbing the forces exerted by the cam 60 in the locking configuration B and of distributing them in the main thrust axis, so as to deform the area 451 of the sheath 40. The crescent 70 ensures balancing of the tensions upon assembly and operation, and this on an optimized compressed surface for this type of work. The crescent 70 also avoids any deterioration of the sheath 40 during the rotation R1 and R0 of the cam 60.

The crescent 70 also includes a boss 78 formed as a protrusion on the internal face 73 on the side of the end 72. The boss 78 forms a stopping notch provided so as to be received in the recess 68 made in the cam 60. The boss 78 extends towards the axis X30 when the device 30 is assembled. The recess 68 and the boss 78 give the possibility of physically materializing both configurations A and B of the device 30. At the end of the rotation R1, the boss 78 passes the abutment 681 and is housed in the recess 68, causing a characteristic sound indicating that the locking configuration B is reached. The abutments 681 and 682 prevent accidental withdrawal of the boss 78 out of the recess 68. However, unlike the abutment 682, the abutment 681 is adapted for crossing the boss 78 during the rotation R1 or R0 of the cam 60, when the key 50 is rotationally moved with a sufficient torque.

Thus, by means of the cooperation of the boss 78 and of the recess 68, but especially by the pressing of the face 73 against the surfaces 632 of the cam 60, the crescent 70 gives the possibility of maintaining the device 30 in the configuration B subsequent to the rotation R1 of the key 50 and of the cam 60 and the compression of the sheath 40, and then of guaranteeing the maintaining of the device 30 in this configuration B when the system 1 is operating. This avoids an accidental loss of the key 50 from the moment that the wear of the nose 12 no longer gives the possibility of ensuring sufficient compression of the sheath 40 in the configuration B.

The joints 80 and 90 are in an elastically deformable material, for example in rubber or any elastomer suitable for the present application. The joints 80 and 90 each have a globally ring shape defined around the axis X30. The joints 80 and 90 are assembled and maintained on the sheath 40 by clipping and adhesive bonding. After assembly, the joints 80 and 90 give the possibility of ensuring the global seal of the device 30 in the housing 14 of the support 10 and against the lugs 23 of the tooth 20. The joints 80 and 90 also give the possibility of absorbing the deformation caused by the tensioning of the device 30, including the changes in positions due to the rotation R1 or R0 of the key 50. The joints 80 and 90 are not shown in FIG. 3 with a simplification purpose.

The joint 80 includes an internal face 81 and an external face 82. The joint 80 has a globally annular shape, with a peripheral wall 83 and a bore 84. The internal face 81 is attached to the end 41 of the sheath 40, by clipping and adhesive bonding in the ring-shaped groove 411. The internal face 81 includes a fork-shaped protrusion 85, adapted so as to be housed in the recess 412 of the sheath 40. Also, the joint 90 includes an internal face 91 and an external face 92. The joint 90 has a global ring shape, with a peripheral wall 93 and a bore 94. The internal face 91 is attached to the end 42 of the sheath 40, by clipping and adhesive bonding in the ring-shaped groove 421. The internal face 91 includes a fork-shaped protrusion 95 adapted so as to be housed in the recess 422 of the sheath 40.

When the device 30 is positioned in the insertion configuration A in the housing 14, the seal is ensured by compression of the joints 80 and 90. The internal faces 81 and 91 face each other on either side of the sheath 40. The external faces 82 and 92 sealably bear against the internal face of the lugs 23. The walls 83 and 93 sealably bear against the internal wall of the housing 14. The bores 84 and 94 sealably bear against the key 50, respectively against the surfaces 514 and 524.

As shown in FIGS. 9 and 10, the system 1 also comprises two plugs 100 and 110 in an elastically deformable material, for example in rubber or any elastomer adapted for the present application. The plugs 100 and 110 are provided so as to be housed in the orifices 25 for obturating the housing 14 and protecting the device 30 when the system 1 is operating. In the same way as the tooth 20, both of these plugs 100 and 110 are then directly subject to aggressions from outer materials, such as dust, sand grains and gravel. The plugs 100 and 110 are dissociated from the mechanical operation of the device 30, but have an important function within the system 1, i.e. protecting the supports of the key 50 in the cavity 26 of the tooth 20. By preventing the intrusion of outer materials into the orifices 25, the plugs 100 and 110 guarantee that the key 50 is mobile with respect to the tooth 20 during the rotation R1 or R0, as well as upon disassembling the key 50 out of the system 1.

The plug 100 comprises an internal face 101 and an external face 102 connected through a border 103. The face 101 includes a basin 104, a pin 105 and a rib 106. The pin 105 is substantially located at the center of the basin 104 and has a quadrilateral section. The rib 106 partly extends at the edge of the basin 104, while being slightly curved around this basin 104, opposite to the face 101. The plug 100 includes a boss 107 protruding on the face 101 and the border 103. When the plug 100 is housed in the cavity 27 of the orifice 25 located on the side 5 of the tooth 20, the pin 105 penetrates into the cavity 516 of the head 51 of the pin 50, the rib 106 penetrates into the portion 262 of the orifice 25 and the boss 107 penetrates into the groove 271 provided for this purpose. The boss 107 further includes a groove 108 provided for receiving a tool, not shown for simplification purposes, in order to withdraw the plug 110.

The plug 110 comprises an internal face 111 and an external face 112 connected through a border 113. The face 111 includes a basin 114, a pin 115 and a rib 116. The pin 115 is substantially located at the center of the basin 114 and has a quadrilateral section. The rib 116 partly extends at the edge of the basin 114, while being slightly curved around this basin 114, opposite to the face 111. The plug 110 includes a recess 117 opening at the face 111 and at the border 113. When the plug 110 is housed in the cavity 27 of the orifice 25 located on the side 6 of the tooth 20, the pin 115 penetrates into the cavity 526 of the foot 52 of the pin 50, the rib 116 penetrates into the cavity 26 of the orifice 25 and the recess 117 receives the boss 272 provided for this purpose.

The operation of the connecting device 30 fitting out the mechanical system 1 is detailed hereafter.

In a first step a), the device 30 is partly assembled. More specifically, a sub-assembly 32 comprising the sheath 40, the cam 60, the crescent 70 and the joints 80 and 90 is assembled. In a first sub-step, the crescent 70 is placed in a mold before injecting the constitutive material of the sheath 40, and this material is then injected into the mold. In other words, the sheath 40 is over-molded on the crescent 70. The crescent 70 is positioned in the portion 49 of the cavity 47, with the face 74 positioned against the surfaces 491 and the grooves 76 positioned in the grooves 492 of the sheath 40. In a second sub-step, the cam 60 is positioned in the portion 48 of the cavity 47. The surfaces 631 and 632 are positioned against the pins 484 and the surfaces 481 of the sheath 40 with more or less play, as well as against the face 73 of the crescent 70. The pins 484 give the possibility of flattening the surface 631 against the face 73. Finally, in a third sub-step, the joints 80 and 90 are positioned at the ends 41 and 42 of the sheath 40, respectively. The sub-assembly 32 may be described as a <<plug>>.

In a second step b), the sub-assembly 32 is inserted into the housing 14 of the support 10, by beginning with the joint 90 and the end 42 of the sheath 40. The surfaces 16 and 46 facing each other form fail-proof means, ensuring indexation of the sheath 40 and allowing an operator to easily locate its specific initial position in the housing 14. The sheath 40 is adjusted in the housing 14, with the wall 44 which deforms slightly in a centripetal way if need be, in particular at the area 451.

In a third step c), the tooth 20 is positioned on the support 10, with the active portion 21 which is oriented so as to be able to scrape and pick up materials during operation of the system 1. The hollow portion 22 is fitted onto the nose 12, with complementary planes bearing against each other. The lugs 23 are received in the housings 13 of the base 11. The orifice 25 located on the side 5 shows the cavity 64 of the cam 60 and the bore 84 of the joint 80 for introducing the key 50.

Alternatively, in a case not shown in FIGS. 1 to 16 when the wall 44 of the sheath 40 is dimensioned so as to be inserted into the housing 14, with or without deformation, by passing through the orifice 25 located on the side 5 of the tooth 20, steps b) and c) may be reversed. Preferably, the operator places the sheath 40 in the support 10 before fitting the tooth 20 onto the support 10.

In a fourth step d), the key 50 is inserted into the internal cavity 64 of the cam 60, by crossing the orifice 25 and the bore 84 on the side 5. The key 50 has a given orientation, i.e. its introduction into the cavity 64 is always carried out with the foot 52 which passes first. The foot 52 penetrates into the cavity 64 through the end 61 and emerges from the cavity 64 at the end 62; the body 53 will be housed into the cavity 64, while the head 51 juts out from the cavity 64 at the end 61. More specifically, the head 51 is positioned in the cavity 26 of the orifice 25 located on the side 5, while the foot 52 is positioned in the cavity 26 of the other orifice 25 located on the side 6. The elements 531, 532 and 533 of the body 53 cooperate with the elements 641, 642 and 643 of the cavity 64, respectively, so that the key 50 cannot be introduced into the cam 60 if the angular orientation of the key 50 is not correct. The marking 515 corresponding to the configuration A is then positioned facing the marking 235 located on the lug 23 on the side 5.

In the configuration A, the key 50 is adjusted in the cam 60, directly in contact with the internal cavity 64, but the head 51 and the foot 52 do not exert any retention forces on the tooth 20, notably in the cavity 26 of each of the orifices 25. The rounded surface 631 of the cam 60 bears against the internal face 73 of the crescent 70, while the planar surfaces 632 bear against the surfaces 481 of the sheath 40, without deforming the area 451 or then in a negligible way. As shown in FIG. 11, the axes X14, X30 and X40 are aligned, the axes X48 and X60 are aligned, the axes X50 and X64 are aligned and located between the axes X40 and X48.

In a fifth step e), the operator uses at least one tool for pivoting the key 50 according to a rotation R1 by 180° around the pivot axis X50, from the insertion configuration A to the locking configuration B. Preferably, the operator uses a tool inserted into the hexagonal cavity 514 of the head 51 and a tool inserted into the hexagonal cavity 524 of the foot 52 in order to exert a torque around the axis X50 on the key 50. The passing from the insertion configuration A to the locking configuration B is illustrated by comparing FIGS. 11 to 16.

The key 50 pivots according to the anticlockwise direction of rotation R1, as seen from the side 5. The key 50 drives the notched cam 60 by cooperation of their securing elements 532, 533, 642, 643 in rotation R1. Because of the off-center distances e50 and e60, the key 50 and the cam 60 change position vertically and horizontally in the cavity 47 of the sheath 40, which is then compressed, in particular at the area 451. Also, the key 50 changes position bearing upon the tooth 20. More specifically, the surface 511 and the lugs 512 and 553 of the head 51 change position in the portions 261, 262 and 263 of the cavity 26 located on the side 5 of the tooth 20, while the foot 52 changes position in the cavity 26 located on the side 6 of the tooth 20.

At the same time, the sheath 40 undergoes several successive partial elastic deformations in the housing 14 during the rotation R1 of the cam 60. More specifically, the external wall 44 and the internal cavity 47 of the sheath 40 are deformed by rotation of the surfaces 632 and intermediate angles are formed between these surfaces 632 of the notched cam 60. The <<jerks>> caused by the successive deformations allow the operator to count the turns, in addition to the visual aid provided by the markings 515.

Upon passing from the configuration A to the configuration B, the axis X60 of the cam 60 is shifted towards the front 2, so that this cam 60 presses against the crescent 70 and the sheath 40 in the area 451. For its part, the key 50 bears against the tooth 20 so that its axis X50 is neither shifted towards the front 2 nor towards the rear 3, but is mobile with a slight vertical displacement. In a plane perpendicular to the axis X50, a length L50A is defined in the configuration A and a length L50B in the configuration B between the front edge of the area 451 and the axis X50, as shown in FIGS. 11 and 14. The length L50B is greater than the length L50A. The difference between the lengths L50A and L50B corresponds to the compression of the sheath 40 in the area 451 in the locking configuration B, this compression is not shown in FIGS. 14 to 16 for simplification purposes, while the key 50 bears against the tooth 20.

Finally, in a sixth step f), the rotation R1 of the device 30 is stopped in the locking configuration B. The key 50 drives the cam 60 into rotation R1 until the abutment 681 crosses the boss 78, which will then be housed in the recess 68, between the abutments 681 and 682. The boss 78 forms a stop notch of the key 50 and of the cam 60 in the locking configuration B, stopping the rotation R1. The marking 515 corresponding to the configuration B is then positioned facing the marking 235 located on the lug 23 on the side 5. Proper positioning of the cam 60 in the cavity 47 of the sheath 40 is also ensured by the cooperation between the internal face 73 of the crescent 70 and the surfaces 632 of the cam 60. The axes X14, X30, X40, X48, X50, X60 and X64 remain parallel with each other, both in the insertion configuration A and in the locking configuration B.

In the locking configuration B, the key 50 bears against the tooth 20, while the sheath 40 as a response bears in the housing 14 of the support 20, by forming a coupling connection between the tooth 20 and the support 10. The cavities 26 of the tooth 20 withstand the change in position and the horizontal thrust of the key 50 along a direction radial to the axis X50, directed from the front 2 to the rear 3 along the axis X1, without generating horizontal forces parallel to the axis X50, and no vertical thrust radial to the axis X50. For its part, the sheath 40 is deformed under the pressure of the crescent 70 and of the cam 60, in particular in the area 451. The housing 14 withstands the deformation and the horizontal thrust of the sheath 50 along a direction radial to the axis X40, directed from the rear 3 to the front 2 along the axis X1, without generating horizontal forces parallel to the axis X40, or any vertical thrust radial to the axis X40. The thrust forces exerted by the sheath 40 in the housing 14 and by the key 50 on the tooth 20 are therefore concentrated along the axis X1.

Thus, when forces are exerted on the active portion 21, the portion 22 of the tooth 20 is firmly retained in the position of use both by the connecting device 30 in the locking configuration B, by the nose 12 and by the walls of the housings 13 receiving the lugs 23.

Subsequently, in a disassembling step g), the operator may use at least one tool, preferably two tools, for pivoting the device 30 in the opposite direction of rotation R0 relatively to the direction of rotation R1. The forces exerted by the device 30 on the tooth 20 and in the support 10 are released, from the locking configuration B to the insertion configuration A. Next, the device 30 may be removed from the system 1, by suppressing the coupling connection between the tooth 20 and the support 10. Thus, the device 30 allows disassembling of the tooth 20 without any hammer, after the wear of the latter, by inversed operations to those of the assembling.

When the mechanical system 1 undergoes wear by matting such that the operation of the device 30 in the locking configuration B is degraded, the invention provides the possibility of replacing the sheath 40 with a new sheath, a so called second phase sheath, having a geometry specifically adapted for compensating the matting of the support 10 which the first sheath 40 can no longer compensate. The modified device 30 then allows replacement of the system 1 under tension in the locking configuration B, with values as significant as during the initial tensioning.

In FIGS. 17 to 28, are illustrated the constitutive elements of a connecting device 130 according to a second embodiment of the invention.

Certain constitutive elements of the device 130 are identical with those of the device 30 of the first embodiment described above and for simplification purposes, bear the same numerical references. Other constitutive elements of the device 130 have similar operation, but a different structure, as compared with the device 30 of the first embodiment, and bear the same numerical references increased by 100 or 1000. Only the differences of the device 130 with the device 30 are described hereafter for simplification purposes.

The device 130 comprises a sheath 40, a key 150, a notched cam 160, a crescent 170, as well as two joints 80 and 90. The device 130 has four locking configurations B1, B2, B3 and B4 which are distinct, which depend on the rotation R1 of the key 150 and of the notched cam 160, and therefore on the time-dependent change in the notching of the cam 160 in the cavity 47 of the sheath 40. These configurations B1, B2, B3 and B4 define the changing compression values of the sheath 40.

Figure 19:
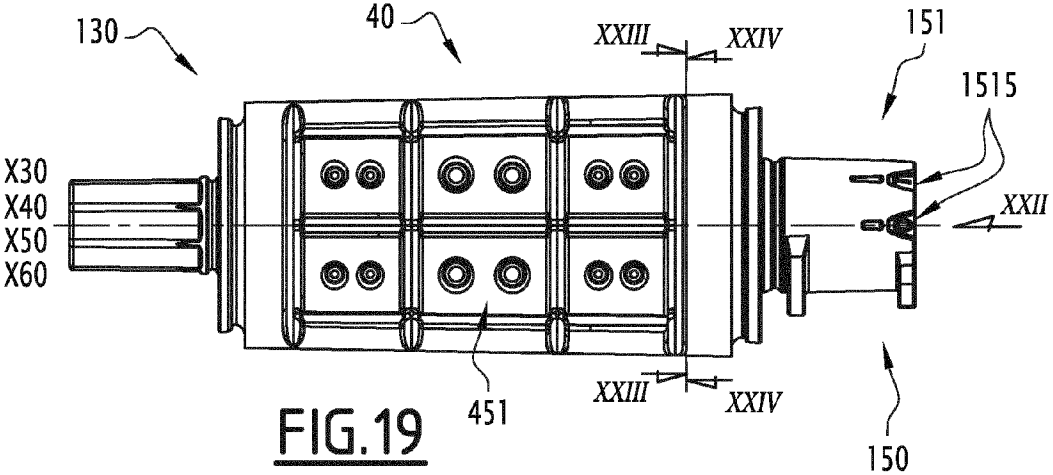
Figure 21:
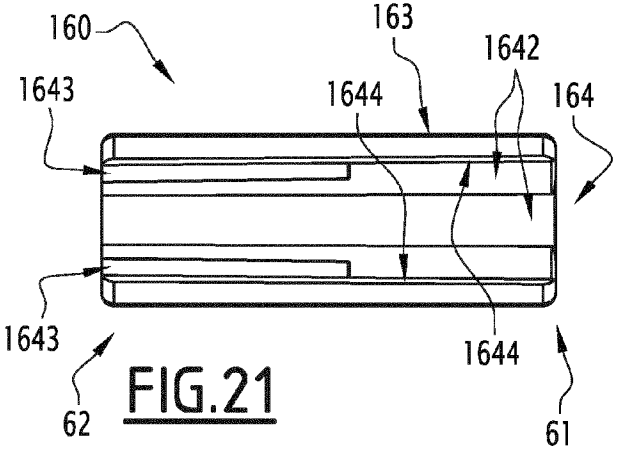
FIG. 21 is a side view along the arrow XXI in FIG. 18, exclusively showing the notched cam.
Figure 20:
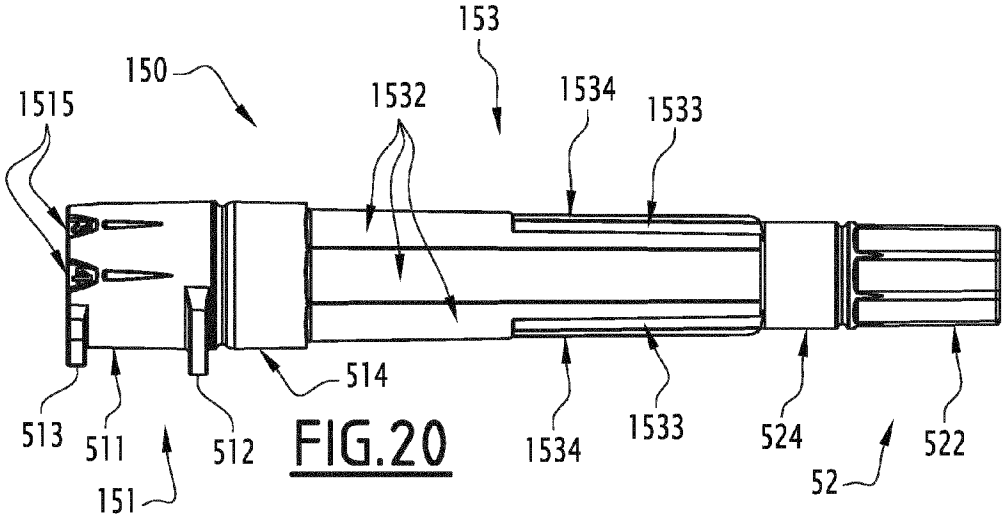
FIG. 20 is a side view along the arrow XX in FIG. 18, exclusively showing the key.
Figures 23, 24, 25, 26, 27, 28:
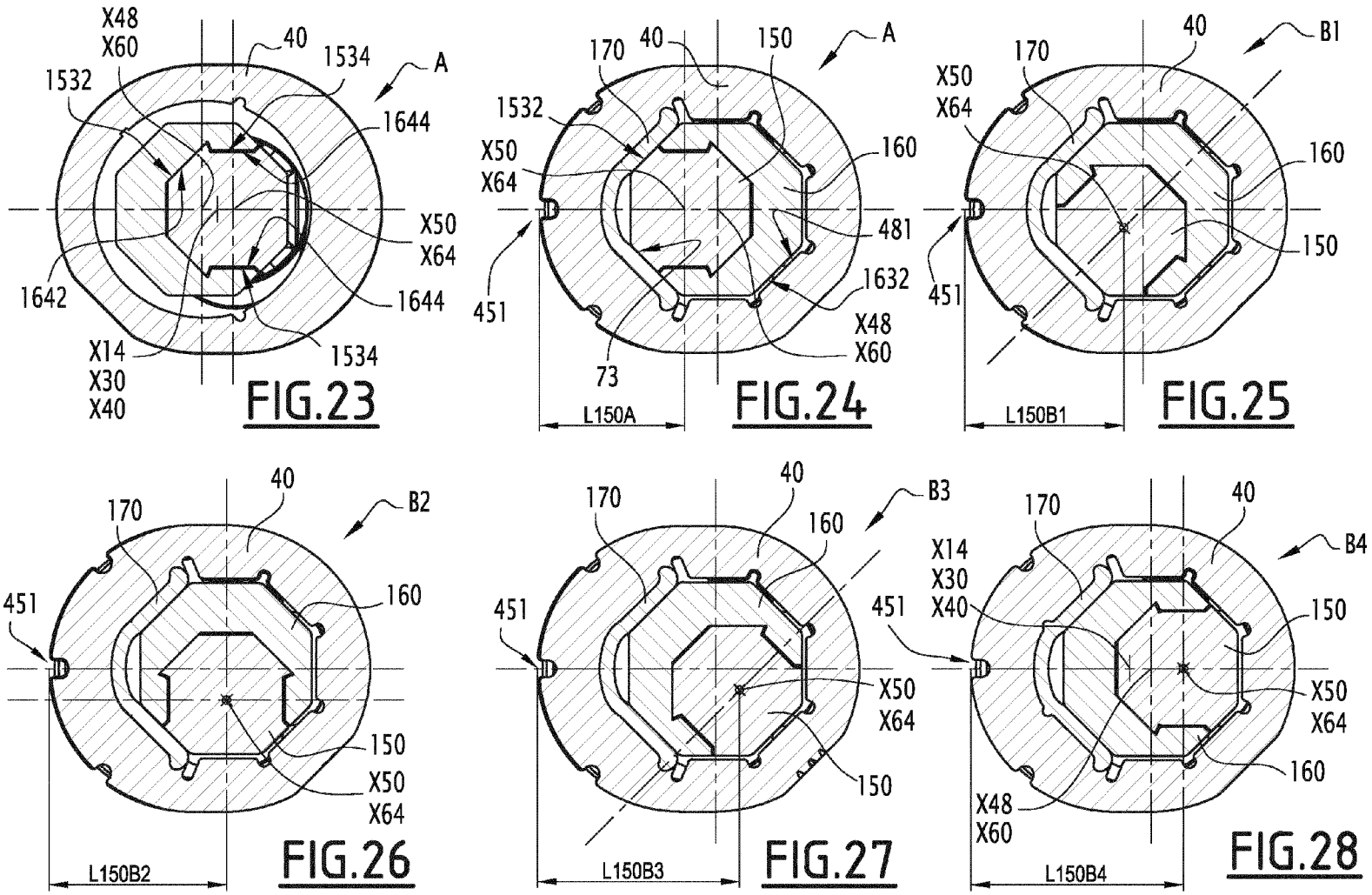
FIG. 23 is a sectional view along the line XXIII-XXIII in FIG. 19.
FIG. 24 is a sectional view along the line XXIV-XXIV in FIG. 19.
FIGS. 25 to 28 are sectional views similar to FIG. 24, showing the connecting device in different locking configurations.

Upon locking the device 130, for passing from the configuration A to the configuration B1, the key 150 and the cam 160 perform a 45° rotation R1. Subsequently, between the configurations B1 and B2, and then B2 and B3, and then B3 and B4, the key 150 and the cam 160 also perform a 45° rotation R1. The insertion configuration A is shown in FIGS. 19, 23 and 24, while the locking configurations B1, B2, B3 and B4 are shown in FIGS. 25 to 28 respectively.

The key 150 comprises a head 151, a foot 52 and a body 153. The head 151 comprises markings 1515, corresponding to the configurations A, B1, B2, B3 and B4. The markings 1515 are provided for facilitating the handling and the orientation of the key 150. The body 153 comprises planar surfaces 1532 and grooves 1534 which extend between the surfaces 514 and 524 and are distributed around the axis X50. In the example of FIGS. 17 to 28, the body 153 comprises six planar surfaces 1532 and two grooves 1534 diametrically opposite. On a same side of the body 153 between both grooves 1534, a groove 1533 is formed on a portion of each of the surfaces 1532 bordering the grooves 1534, on the side of the surface 514 of the head 51. The grooves 1534 are wider and more elongated than the grooves 1533. The elements 1532, 1533 and 1534 form positioning and indexation means defined in correspondence with the cam 60.

The notched cam 160 comprises an external wall 163 and an internal cavity 164 connected through an aperture 167. The wall 163 includes seven planar surfaces 1632, but no rounded surface. The cavity 164 includes three neighboring planar surfaces 1642, as well as two diametrically opposite ribs 1644, which extend along the axis X60. The ribs 1644 border the aperture 167, which crosses the cam 60 over the whole of its length, between the ends 61 and 62. A rib 1643 is formed on a portion of each of the surfaces 1642 bordering the grooves 1534, on the side of the end 62. The ribs 1644 are wider and more elongated than the ribs 1564. The surfaces 1642 are provided so as to bear upon the surfaces 1532, the ribs 1643 are provided so as to be housed in the recesses 1533, while the ribs 1644 are provided so as to be housed in the grooves 1534, when the key 150 is inserted into the cam 160 in the insertion configuration A.

In practice, the surfaces 1632 of the notched cam 160 define given positioning values and specific to each notch position, in other words to each locking configuration B1, B2, B3 and B4. These are mainly changes in position of these surfaces 1632 which allow a change in the distances between the axes X40, X50 and X60 during the rotation R1 of the key 150, thereby ensuring the catching up of the wearing plays by the progressive compression at each notch change, i.e. at each locking configuration B1, B2, B3 and B4.

The crescent 170 comprises an external face 74 and an internal face 173 which does not include any boss 78, except for the fact that the crescent 170 has an operation similar to that of the crescent 70. The crescent 170 in particular gives the possibility of physically materializing the proper position of the notches of the cam 160 in each of the locking configurations B1, B2, B3 and B4.

Globally, the device 130 has an operation similar to the device 30. However, to each locking configuration B1, B2, B3 and B4 corresponds a given compression to the sheath 40 against the wall of the housing 14.

When the mechanical system 1 undergoes wear by matting such as the operation of the device 130 in the first locking configuration B1 is degraded, the invention provides the possibility of passing to the second locking configuration B2, so as to compensate for the matting of the support 10 which the first locking configuration B1 can no longer compensate. The device 130 then allows replacement of the tensioned system 1 with values as significant as during the initial tensioning. Subsequently, the device 130 may pass to the configuration B3, and then to the configuration B4. The key 150 and the cam 160 pivot by a given angle between each locking configuration B1 to B4, in this case an angle equal to 45° on the example of FIGS. 24 to 28. The change in notching from the configuration A as far as the configuration B4 defines a maximum angular travel of 180°, i.e. a full half-turn. This limit having been crossed, there is no possibility to go beyond this, since the rotation R1 of the key 150 will then be slowed down by the tooth 20. This possibility of a change in the notching gives the possibility of permanently maintaining the tooth 20 on its support 10, and this with significant compression values, in certain cases beyond the lifetime of the support 10.

By passing from the configuration A to the configurations B1 to B4, the axis X60 of the cam 160 is shifted towards the front 2, so that this cam 160 bears against the crescent 170 and the sheath 40 in the area 451. For its part, the key 150 bears against the tooth 20 so that its axis X50 is neither shifted towards the front 2 nor towards the rear 3, but is mobile with a slight vertical displacement. In a plane perpendicular to the axis X50, different lengths L150A, L150B1, L150B2, L150B3, L150B4 are defined between the front edge of the area 451 and the axis X50, respectively corresponding to the configurations A and B1 to B4, as shown in FIGS. 24 to 28. The lengths L150A to L150B4 are increasing lengths. The difference between each pair of successive lengths corresponds to the compression of the sheath 40 in the area 451 in the locking configuration B1 to B4, this compression not being shown in FIGS. 14 to 16 for simplification purposes, while the key 150 bears against the tooth 20.

Moreover, the mechanical system 1 and the connecting device 30 or 130 may be conformed differently from FIGS. 1 to 28 without departing from the scope of the invention. In particular, each of the constitutive elements 40, 50 or 150, 60 or 160, 70 or 170, 80 and/or 90 of the device 30 or 130 may have different shapes adapted to the present application.

In an alternative not shown, the orifices 25 made in the lugs 23 may include reinforced shoulders and/or heat treatments at the areas in contact with the key, in order to exhibit increased surface hardness and facilitate blocking of the key in the locking configuration of the device.

According to another alternative not shown, the tooth 20 includes a single orifice 25 open on one of the sides 5 or 6, for inserting the key 50 or 150, but not on the other side of the tooth 20. In this case, the device 30 includes a single joint 80 or 90 and the system 1 includes a single plug 100 or 110.

According to another alternative not shown, the sheath 40 may comprise a metal insert, for example embedded into the bulk of elastomeric material.

According to another alternative not shown, the cam 60 or 160 has a globally circular or oval and non-polygonal section. In other words, the outer wall 63 or 163 is smooth, without any planar surfaces.

Further, the technical characteristics of the different embodiments and alternatives mentioned above may, in totality or for certain of them, be combined with each other. Thus, the mechanical system may be adapted in terms of cost and of performance.

The invention claimed is:

1. A mechanical system, comprising a support, a wearing part and a connector between the wearing part and the support, wherein the support, the wearing part and the connector are comprised in a piece of equipment of a public works machine, the connector comprising:

a sheath made of an elastically deformable material, comprised of a first internal cavity and an external wall adjustable in a housing of the support, a key comprising an elongated body along a key axis, and a cam provided with an external adjustable wall in the first internal cavity of the sheath and with a second internal cavity provided for receiving the key, wherein the connector is positioned in the housing of the support, the key and the cam are mobile and rotationally secured to each other in the first internal cavity of the sheath, between:

a configuration for insertion of the key into the cam, and at least one locking configuration in which the key bears against the wearing part in a radial direction from an axis of the key, while the cam bears against the sheath so as to deform the external wall of the sheath against the housing of the support, thereby forming a coupling connection between the wearing part and the support.

2. The mechanical system according to claim 1, wherein the key and the cam are mobile and rotationally secured to each other in the first internal cavity of the sheath between the insertion configuration and the single locking configuration by pivoting by a given angle.

3. The mechanical system according to claim 2, wherein the connector comprises a recess and a boss configured for notching the cam in the locking configuration.

4. The mechanical system according to claim 3, wherein the recess and the boss are formed by a recess made on the cam and a boss formed in another constitutive element of the connector.

5. The mechanical system according to claim 1, wherein the key and the cam are secured to each other in rotation in the first internal cavity of the sheath between several locking configurations, by pivoting by a given angle between each locking configuration.

6. The mechanical system according to claim 5, wherein the connector comprises notching surfaces for notching the cam in each of the locking configurations.

7. The mechanical system according to claim 6, wherein the notching surfaces are formed by internal planar surfaces belonging to the sheath and external planar surfaces belonging to the cam.

8. The mechanical system according to claim 1, wherein the connector also comprises an intermediate part positioned against the cam in the first internal cavity of the sheath, the intermediate part comprising an internal face bearing against the external wall of the cam and an external face bearing against the internal wall of the sheath.

9. The mechanical system according to claim 1, wherein the connector also comprises at least one ring-shaped joint adapted for being positioned at a longitudinal end of the sheath, and wherein the insertion configuration and in the locking configurations, said at least one ring-shaped joint bears both against the support, the wearing part, the sheath, and the key.

10. The mechanical system according to claim 1, wherein it also comprises at least one plug configured for being positioned in an orifice of the wearing part which will face the housing of the support when the wearing part is mounted on the support said at least one plug preventing the intrusion of outer materials around the key and in the housing of the support.

11. The mechanical system according to claim 1, wherein the key comprises a head and a foot adapted so as to be each housed in a respective cavity of the wearing part, and wherein in said at least one locking configuration, the head and the foot radially to the key axis bear against one of the cavities of the wearing part along a first direction while the body radially to the key axis bear against the cam along a second direction opposite to the first direction.

12. The mechanical system according to claim 1, wherein the key comprises lugs for dual axial retention along the key axis in said at least one locking configuration.

13. The mechanical system according to claim 1, wherein the key and the cam comprise securements for making them secured in rotation.

14. The mechanical system according to claim 13, wherein the securements in rotation are formed by ribs and complementary grooves made on the key and the cam.

15. A public works machine bucket, wherein the public works machine bucket comprises at least one mechanical system according to claim 1.

16. The mechanical system according to claim 9, wherein the mechanical system comprises two ring-shaped joints adapted for being positioned at a longitudinal end of the sheath.

17. The mechanical system according to claim 10, wherein the mechanical system comprises two plugs adapted so as to be each positioned in an opening of the wearing part.

18. The mechanical system according to claim 1, wherein the wearing part is a bucket tooth.

* * * * *